United States Patent [19]

Aiura et al.

[11] Patent Number: 4,643,265

[45] Date of Patent: Feb. 17, 1987

[54] CORE BARREL APPARATUS FOR DISPOSING A CORE WITHIN A THIN, FLEXIBLE FILM CASING

[75] Inventors: Noboru Aiura, Tokyo; Yoshio Sawaki, Kawasaki, both of Japan

[73] Assignee: Norton Christensen, Inc., Salt Lake City, Utah

[21] Appl. No.: 707,895

[22] Filed: Mar. 4, 1985

[51] Int. Cl.[4] ..... E21B 25/06

[52] U.S. Cl. ..... 175/226; 175/249

[58] Field of Search ..... 175/249, 226, 245, 246, 175/58, 59

[56] References Cited

U.S. PATENT DOCUMENTS

| | | | |
|---|---|---|---|
| 2,615,680 | 10/1952 | Kjellman et al. | 175/245 X |
| 2,927,775 | 3/1960 | Hildebrandt | 175/245 X |
| 2,927,776 | 3/1960 | Hildebrandt | 175/245 X |
| 3,298,450 | 1/1967 | Sato | 175/226 |
| 3,511,324 | 5/1970 | Pieters et al. | 175/245 X |
| 3,690,389 | 9/1972 | Van de Beld et al. | 175/249 X |
| 3,807,234 | 4/1974 | Duperon | 175/249 X |
| 4,156,469 | 5/1979 | Laskey | 175/245 X |
| 4,258,803 | 3/1981 | Thompson et al. | 175/245 X |

*Primary Examiner*—James A. Leppink
*Assistant Examiner*—Matthew Smith
*Attorney, Agent, or Firm*—Beehler, Pavitt, Siegemund, Jagger, Martella & Dawes

[57] ABSTRACT

An unconsolidated or loose core is retrieved and retained within a coring tool by wrapping the core with a resilient thin film sleeve. The sleeve is compacted and stored within a concentric cylindrical storage space outside of the core and within the tool. The thin film compacted sleeve is then drawn from the storage space and wrapped about the core. The thin film sleeve is characterized by having a longitudinal length several times greater than the corresponding longitudinal length of the storage space in which it is compacted and stored. More particularly, the thin film sleeve is compactly stored in a cylindrical space defined within an inner tubular mandrel concentric with the core and an outer tubular mandrel concentric with the core. The two mandrels are concentric with each other and spaced apart to form an annular circumferential opening through which the thin film sleeve is disposed and drawn. The thin film sleeve is coupled to a guide plug, which is axially disposed and longitudinally displaceable within the core barrel of the coring tool. When the core is disposed into the core barrel, it comes in contact with the guide plug which is then displaced relatively upward within the coring tool, drawing the compacted thin film sleeve from its cylindrical annular storage space about the concentric core within. Typically, the thin film sleeve is a 4 mil resin, plastic or rubber tubular, cylindrical sleeve.

2 Claims, 4 Drawing Figures

FIG. 2
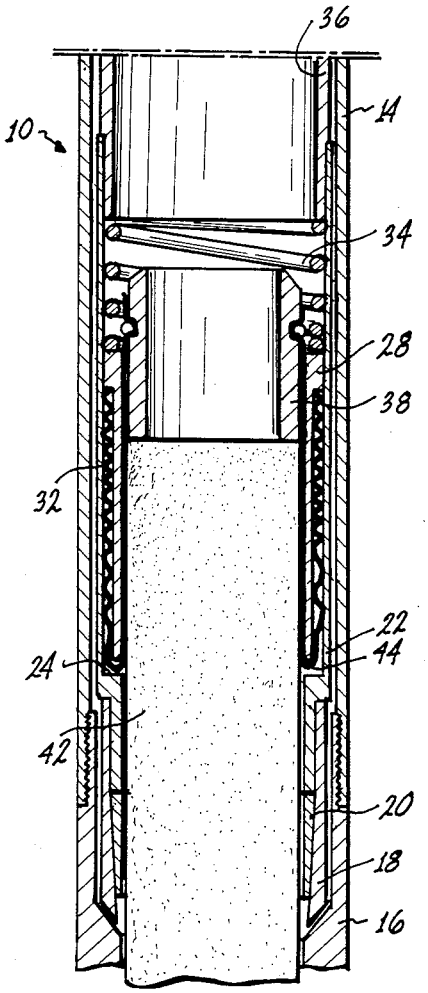
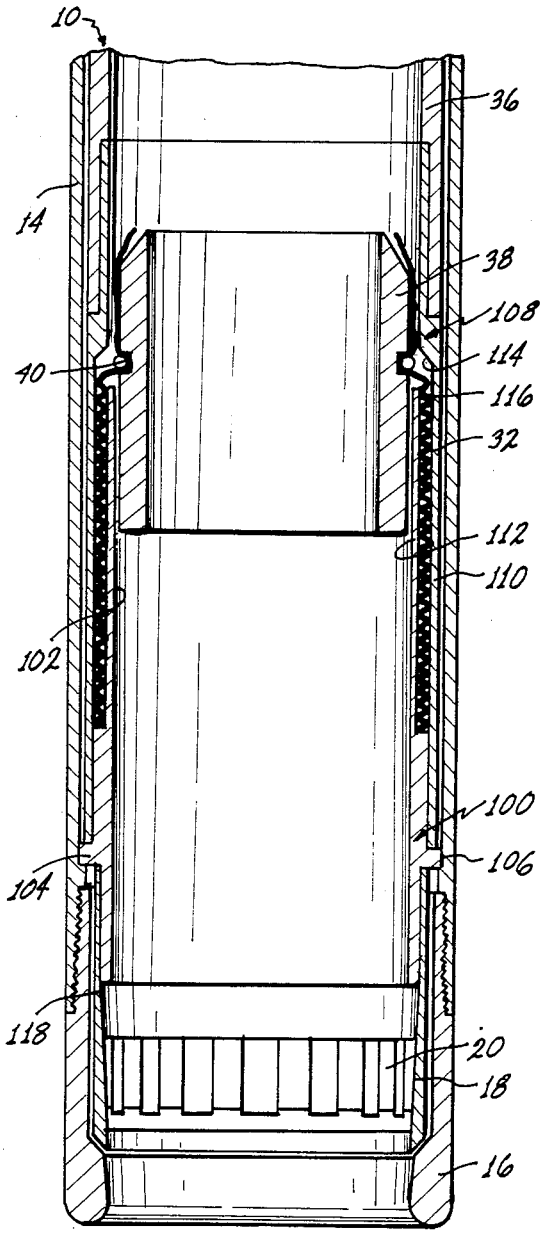
FIG. 3

CORE BARREL APPARATUS FOR DISPOSING A CORE WITHIN A THIN, FLEXIBLE FILM CASING

BACKGROUND OF THE INVENTION

1. Field of the Invention

The present invention relates to the field of earth boring tools and more particularly to apparatus for recovering cores from rock formations.

2. Description of the Prior Art

Conventional core barrels normally dispose the cut core into a metal or hard synthetic resin tube which is axially disposed within the inner barrel of the coring tool. The coring tool or some portion therein is retrieved at the well's surface and the metal or hard synthetic resin tube used as a casing to retain the core within the tool during retrieval and thereafter for transportation to a laboratory. However, it is extremely difficult to recover undisturbed cores in a coring operation using metal or hard resin core tubes if the core is taken from a highly unconsolidated rock formation or the rock is badly fractured. Often, such broken cores jam or wedge in the metal or hard resin tube thereby stopping the coring operation.

What is needed is some type of coring tool design wherein the core may be kept intact, but where a badly fractured or unconsolidated core is accepted without a high risk of jamming.

BRIEF SUMMARY OF THE INVENTION

The present invention includes an apparatus for retaining and retrieving cores comprising a tubular mandrel mechanism for defining an annular space. The core is disposed concentrically within the mandrel mechanism. A pliable sleeve is stored within the annular space. The pliable sleeve is characterized as a thin film material. The guide plug mechanism is concentrically disposed within the mandrel mechanism and is coupled to the pliable sleeve. The guide plug mechanism abuts the core when the core is disposed within the apparatus and draws the pliable sleeve from the annular space thereby wrapping the pliable sleeve about the core as the core is disposed into the apparatus. By reason of this combination of elements a substantial length of the pilable sleeve, which is made of a thin film material, is disposed in the annular space, and the pliable sleeve is wrapped about the core to retain the core intact even when the core is unconsolidated and fractured.

In one embodiment the pliable sleeve is comprised of a rubber film. In another embodiment the pliable sleeve is comprised of soft synthetic resin film. In a still further embodiment the pliable sleeve is characterized by a thickness of 10 mils of less. The pliable sleeve may also be characterized by a thickness of 4 mils or less in other embodiments. The pliable sleeve is characterized by a longitudinal length substantially greater than the longitudinal length of the annular space defined in the mandrel mechanism. In a first embodiment the longitudinal length of the pliable sleeve is substantially greater than twice the longitudinal length of the annular space. The longitudinal length of the pliable sleeve in fact may be substantially greater than 10 times the longitudinal length of the annular space.

The pliable sleeve is extensible and has a diameter in the nonextended configuration which is less than the diameter of the core.

The pliable sleeve is characterized by at least one slippery surface thereby tending to lubricate relative movement of the sleeve when disposed about the core and contiguous portions of the apparatus.

More particularly the mandrel mechanism comprises a spring loaded inner cylindrical tubular mandrel which longitudinally extends within the apparatus, an outer tubular mandrel which is concentric with the inner mandrel and which longitudinally overlaps the inner mandrel to define the annular space between the inner mandrel and outer mandrel. The inner and outer mandrel are urged into contact at the lower extremity of the inner mandrel. The pliable sleeve is disposed between the inner and outer mandrels across the lower extremity of the inner mandrel at the point of contact between the mandrels. The pliable sleeve is temporarily secured in place by resilient compression of the inner mandrel toward the outer mandrel. By this combination of elements the pliable sleeve is fed about the core under tension at a rate no greater than relative disposition of the core into the apparatus.

More specifically the invention includes an apparatus for retrieving and retaining a core comprising a barrel for receiving the core, a sleeve storage mechanism for storing a sleeve disposable over the core within the barrel. The sleeve storage mechanism is characterized by a longitudinal length within the apparatus of a predetermined magnitude. A film sleeve is disposed within the sleeve storage mechanism and compacted therein. The film sleeve has a longitudinal length, when uncompacted, greater than the longitudinal length of the sleeve storage mechanism. A guide plug mechanism is coupled to the film sleeve. The guide plug mechanism is axially disposed within the barrel, and arranged and configured to contact the core when the core is disposed into the barrel. Relative disposition of the core into the barrel longitudinally disposes the guide plug mechanism within the barrel and draws the film sleeve from the sleeve storage mechanism. By reason of this combination of elements a simple compact design is effectuated to embrace the core within the film sleeve to avoid jamming the core within the apparatus.

In one embodiment the film sleeve has a diameter less than the core and is comprised of resilient material so that when the film sleeve is drawn from the sleeve storage mechanism it resiliently contracts about and encloses the core.

The invention further includes a method of retrieving and retaining a core within a coring apparatus comprising the steps of cutting the core, disposing the core into the apparatus, and enshrouding the core in a thin film cylindrical, tubular sleeve. In the step of enshrouding the core, the thin film sleeve is first stored in a compacted configuration within a concentric cylindrical space defined outside of the core. Then the compacted thin film sleeve is drawn from the annular cylindrical storage space, stretched to assume an uncompacted configuration and disposed about the core.

In particular the step of enshrouding the core with the thin film sleeve further comprises the step of maintaining the thin film sleeve under tension as it is stretched to assume the uncompacted configuration and wrapped about the core.

DESCRIPTION OF THE DRAWINGS

FIG. 2 is the cross-sectional portion of FIG. 1 showing the core operatively inserted into the tool.

FIG. 3 is a cross-sectional view of a second embodiment of a coring tool incorporating the invention.

Figure 1:
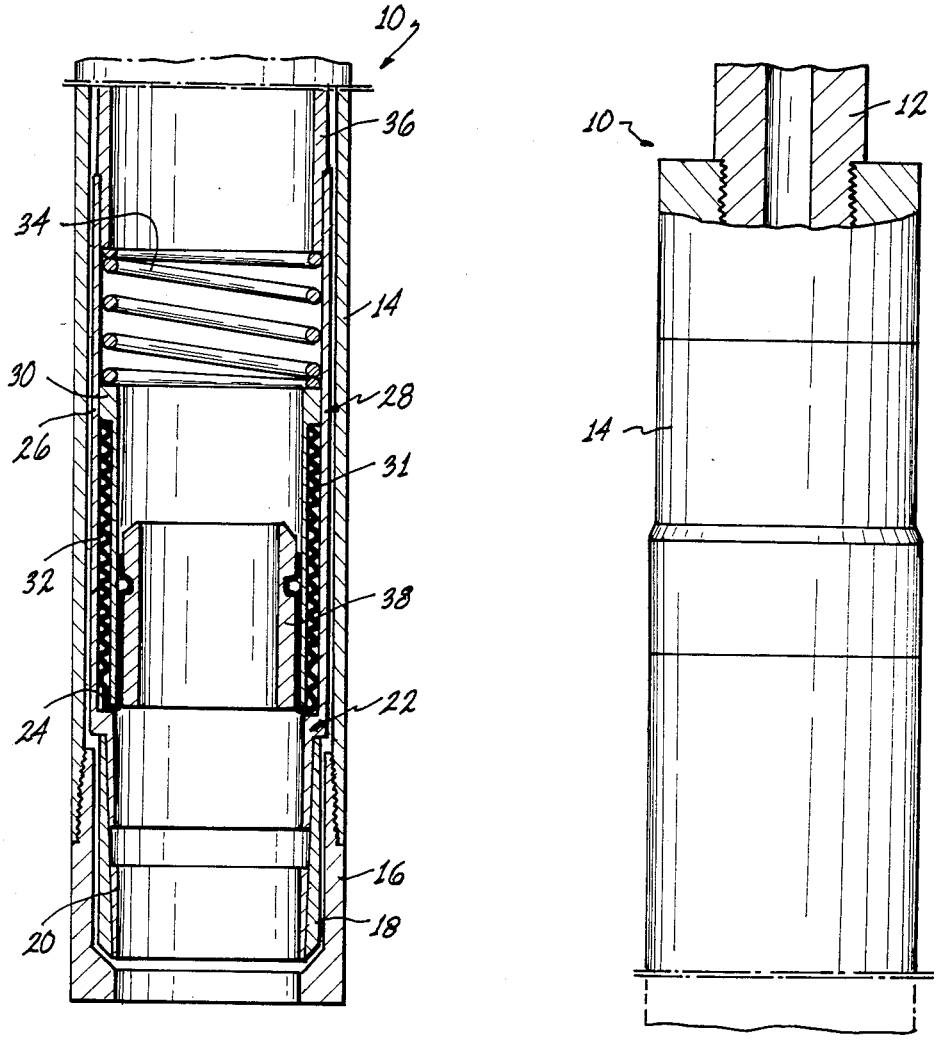
FIG. 1 is a cross-sectional view of the lower portion of a coring tool incorporating the invention.

The various embodiments, their advantages and the modes of their operation can now be better understood by turning to the following detailed description.

DETAILED DESCRIPTION OF THE PREFERRED EMBODIMENTS

The present invention is an improved core barrel apparatus for receiving and retrieving cores from a bore hole which progressively encases the core in a pliable, lubricating thin sleeve while keeping the core intact. The apparatus is devised so as to encase the cut core within a very thin, cylindrically formed, pliable or film sleeve which is wrapped about the core as the core extends into the receiving portion of the core barrel. The thin film, cylindrical casing or sleeve is compactly compressed within an annular space defined between an axial core receiving mandrel and the outer sleeve of the coring tool. As the core is disposed into the axial space defined by the receiving mandrel, the compacted pliable sleeve is fed out of the annular space in which it is stored and is disposed over the core. The invention may be better understood, however, by first turning to consider the embodiment illustrated in FIGS. 1 and 2.

Turn firstly to FIG. 1 which shows in broken, partial cross-sectional view a coring tool, generally denoted by reference numeral 10. Coring tool 10 is adapted to be lowered into a bore hole by means of a tubular drill rod 12 shown in partial cross-sectional view in the right hand side of FIG. 1. Drill rod 12 is threadably connected to an outer tube 14. Outer tube 14 longitudinally extends down the drill string and is ultimately threadably connected to a coring bit 16. In the illustrated embodiment of FIG. 1 outer tube 14 is shown as directly threaded to coring bit 16, but it may also be connected thereto through one or more shoes if desired according to conventional design. Concentrically disposed within coring bit 16 is a conventional core catcher shoe 18. Shoe 18 forms a cylindrical open segment with an interior frustoconical surface upon which a conventional core catcher 20 rides. As the cut cores is disposed up through the cylindrical space defined within core catcher 20 and shoe 18, upward longitudinal movement is freely permitted. However, when tool 10 is moved longitudinally upward, core catcher 20 seizes the core and is forced longitudinally downward along the internal frustoconical surface of shoe 18 thereby causing core catcher 20 to become radially compressed, to seize the core, to crush it and to break it from the underlying rock formation.

Slidingly disposed within the upper portion of shoe 18 is an outer extension tube 22. Cylindrical outer extension tube 22 has a lower portion of reduced diameter which snuggly fits or mates into the upper portion of shoe 18, a shoulder portion 24, and, longitudinally extending from shoulder portion 24, a radially expanded cylindrical extension 26 which longitudinally extends upwardly within outer tube 14. Slidingly disposed within extension segment 26 of extension tube 22 is an inner mandrel, generally denoted by reference numeral 28. Inner mandrel 28 is a tubular member including an upper collar portion 30, which is in sliding contact with the inner surface of cylindrical portion 26 of extension tube 22. A thinner reduced diameter lower portion 31 of mandrel 28 extends longitudinally downward within tool 10 and abuts shoulder 24 of extension tube 22. The inner surface of mandrel 28 thereby provides a substantially smooth surface, which is contiguous to the interior surface of the lower portion of extension tube 22.

However, mandrel 28 and, in particular, its lower axial radially reduced portion 31, defines an annular space between portion 26 of outer extension tube 22 and lower extending portion 31 of mandrel 28. As will be described in greater detail below, a pliable, thin sleeve 32 is compacted within this annular space.

A coil compression spring 34 is longitudinally disposed above mandrel 28 and has its lower end in contact with and bearing against shoulder 30 of mandrel 28. The opposing end of compression spring 34 bears against the lower end of an inner tube 36. Inner tube 36 is longitudinally fixed within tool 10 although it is rotationally stationary. Inner tube 36 is coupled to outer tube 14 by means of a conventional bearing assembly (not shown) and thus remains rotationally fixed while outer tube 14 rotates. Similarly, compression spring 34, mandrel 28, outer extension tube 22, shoe 18 and core catcher 20 will generally remain rotationally fixed as well, thereby leaving the core undisturbed and intact as it is advanced into tool 10.

Consider now sleeve 32 in greater detail. A guide plug 38 is axially disposed within mandrel 28 and freely slides therein. Guide plug 38 is of such a diameter that it is also free to be longitudinally disposed through the interior of compression spring 34 and inner tube 36. Sleeve 32 extends from its annular storage space around the lower longitudinal end of portion 31 of mandrel 28 and turns to longitudinally encase or wrap guide plug 38. Sleeve 32 is fixed to guide plug 38 by means of a compressive retention ring 40 which is disposed in a mating annular circumferential slot defined in guide plug 38. The thin film material of sleeve 32 is disposed between guide plug 38 and compression ring 40 and is thereby secured to guide plug 38.

Turn now to the cross-sectional partial view of FIG. 2 wherein tool 10 of FIG. 1 is illustrated showing the disposition of a cut core 42 within tool 10. As core 42 is advanced into the inner barrel of tool 10, its upper surface will ultimately come into contact with the lower surface of guide plug 38. Guide plug 38, is then freely moved upwardly within the barrel space. However, in order to longitudinally move upward, guide plug 38 must pull sleeve 32 from its annular storage space, around end 44 of mandrel 28, outside and around core 42 and longitudinally upward within the interior surface of mandrel 28. The frictional forces against sleeve 32 and the upward force exerted upon guide plug 38 by advancing core 42 is sufficient to slightly compress compression spring 34 and thereby lift mandrel 28 off of shoulder 24. This allows sleeve 32, which otherwise tends to be maintained in a fixed position by virtue of the compressive abutment of end 44 against shoulder 24, to move freely upward thereby encasing or embracing core 42.

Core 42 continues to advance within the core barrel space of tool 10 and sleeve 32 is disposed about it. Sleeve 32 is pliable, flexible and thin and may be made of a rubber or rubberized film or soft synthetic resin film materials. In the illustrated embodiment sleeve 32 is in fact approximately four mils (0.10 millimeter) thick. Therefore, sleeve 32, by virtue of its thickness and inherent consistency, is extensible, at least to a degree, and actually embraces or slightly compresses core 42 to retain it intact. This is particularly useful in sandy or extremely loose formations. However, since sleeve 32 is made of pliable material, when a fragmented rock core is taken, sleeve 32 has sufficient pliability to give, thereby tending to avoid jamming the core within the core barrel. Furthermore, it is contemplated that sleeve 32 may be made of a lubricating or slippery synthetic resinous material, such as a teflon coated plastic, to further provide a means for reducing the tendency of fragmented cores to wedge or jam within the core barrel, typically within inner tube 36. Finally, since the diameter of pliable sleeve 32 is smaller than core diameter 42, core 42 is continuously supported while it is advancing within the core barrel and most problems encountered by conventional core barrels will thus be eliminated.

Turn now to FIG. 3 wherein a second embodiment of the invention is depicted in cross-sectional view in enlarged scale. Like elements have been referenced by like numerals while the distinguishable elements of the second embodiment are labeled by reference numerals 100 or greater. Once again an outer tube 14 as coupled to a conventional coring bit 16. A core catcher shoe 18 is axially disposed within bit 16 to provide an interior frustoconical surface upon which core catcher 20 rides. Slidingly disposed within and concentric with the upper portion of shoe 18 is a mandrel, generally denoted by reference numeral 100. Mandrel 100 includes a lower cylindrical portion disposed inside of shoe 18, and longitudinally extends upward to form a thin cylindrical tubular extension 102. The lower portion of mandrel 100 is radially extended to form a circumferential annular rib 104 riding on a corresponding shoulder 106, which circumferentially and annularly defined on the inside surface of outer tube 14. Inner tube 36 is coupled to an outer mandrel 108. In the illustrated embodiment outer mandrel 108 includes an upper portion which is circumferentially and axially disposed within the lower end of inner tube 36. Outer mandrel 108 continues longitudinally downward outside of an concentric with inner mandrel 100 by means of a cylindrical tubular extension 110. Between the inside upper extension 112 of inner mandrel 100 and the lower outside extension of outer mandrel 108 is defined an annular space in which sleeve 32 is disposed. However, inner extension 112 of mandrel 100 longitudinally extends upward within tool 10 to a predetermined distance below a lower shoulder 114 defined in outside mandrel 108. Below lower shoulder 114, outside mandrel 108 longitudinally extends downward to form cylindrical extension 110. Therefore, a small gap is defined between shoulder 114 and upper end 116 of mandrel 100. Sleeve 32 is disposed through this gap and is attached to guide plug 38 by means of compression ring 40 in the same manner as described in connection with the embodiment of FIGS. 1 and 2.

Consider now the operation of the second embodiment of FIG. 3. Although not illustrated in the drawings, as a core is disposed within the barrel of tool 10, the upper face of the core will ultimately come into contact with guide plug 38. When the core is in contact with guide plug 38 it will begin to longitudinally displace guide plug 38 upward within the core barrel. As guide plug 38 is thus displaced, it will draw the pliable sleeve 32 upwardly and out of the annular storage space in which it has been compacted between mandrels 100 and 108. As in the embodiment of FIGS. 1 and 2, because of the flexibility and thinness of sleeve 32, the amount of material which can be compacted or stored within the annular space between outside mandrel 108 and inside mandrel 100 is substantial and can easily accomodate virtually any desired core length.

The embodiment of FIG. 3 is particularly characterized by its simplicity and by the fact that only a single moving element, namely guide plug 38, is required for its successful operation. In addition, the design of FIG. 3 provides a smooth inner surface within tool 10 into which the core may be disposed. Above mandrel 100 a substantially smooth and flush interior surface is provided throughout the entire available core space. Although the illustrated embodiment of FIG. 3 depicts a small shoulder 118 at the lower end of inside mandrel 100 it is entirely within the scope of the invention that the lower end of mandrel 100 can be tapered, smoothed and faired into the adjacent interior surface of shoe 18.

Many modifications and alterations may be made by those having ordinary skill in the art without departing from the spirit and scope of the invention. The illustrated embodiments have therefore only been set forth as an example and should not be taken as limiting the invention which is defined in the following claims.

We claim:

1. An apparatus for retrieving and retaining a core having an elongated longitudinal core axis comprising:

barrel means for receiving said core, said barrel means having a longitudinal barrel axis coaxial with said longitudinal core axis;

sleeve storage means for storing a sleeve disposable over said core, said sleeve storage means characterized by a longitudinal length of a predetermined magnitude coaxial with said longitudinal barrel axis of said barrel means;

a film sleeve disposed within said sleeve storage means and compacted therein, said film sleeve having a longitudinal length when uncompacted coaxial to said longitudinal barrel axis of said barrel means greater than said longitudinal length of said sleeve storage means; and guide plug means coupled to said film sleeve, said guide plug means axially disposed within said barrel means and arranged and configured to contact said core when said core is disposed into said barrel means, relative disposition of said core into said barrel means longitudinally disposing said guide plug means within said barrel means and drawing said film sleeve from said sleeve storage means, wherein said sleeve storage means defines an annular cylindrical space concentric with and outside of said barrel means and is further characterized by a circumferential annular opening at the lower end of said sleeve storage means through which said film sleeve is disposed and longitudinally drawn upward within said barrel means, said sleeve storage means further comprising means for tending to close said annular circumferential opening and cause said sleeve storage means to contact said sleeve, thereby tending to retain said film sleeve disposed through said annular circumferential opening in place unless drawn through said opening by an upward longitudinal tension applied to said film sleeve through said guide plug means, which upward longitudinal tension overcomes said urging of said sleeve storage means to close said annular circumferential opening against said sleeve, whereby said film sleeve is disposed about said core under longitudinal tension, to avoid jamming said core within said apparatus.

2. An apparatus for retaining and retrieving cores comprising:

tubular mandrel means for defining an annular space, said core disposable concentrically within said mandrel means wherein said mandrel means comprises a spring loaded inner cylindrical tubular mandrel longitudinally extending within said apparatus; and an outer tubular mandrel concentric with said inner mandrel and longitudinally overlapping said inner mandrel to define said annular space between said inner mandrel and outer mandrel, said inner and outer mandrels being urged into mutual contact at the lower extremity of said inner mandrel;

a pliable sleeve stored within said annular space, said pliable sleeve characterized as thin film material, said pliable sleeve being disposed between and contacted by said inner and outer mandrels across said lower extremity of said inner mandrel at said point of contact, said pliable sleeve being temporarily secured in place by resilient compression of said inner mandrel toward said outer mandrel against said sleeve; and guide plug means concentrically disposed within said mandrel means and coupled to said pliable sleeve, said guide plug means for abuting said core when said core is disposed within said apparatus and for drawing said pliable sleeve from said annular space to thereby wrap said pliable sleeve about said core as said core is disposed into said apparatus;

whereby said pliable sleeve is fed about said core under tension at a rate no greater than relative disposition of said core into said apparatus, whereby a substantial length of said pliable sleeve made of said thin film material is disposed in said annular space, and whereby said pliable sleeve is wrapped about said core to retain said core intact even when said core is unconsolidated and fractured.

* * * * *